United States Patent [19]

Keller

[11] Patent Number: 4,510,768

[45] Date of Patent: Apr. 16, 1985

[54] ADJUSTABLE ICE BREAKER FOR AN ICE MACHINE PRODUCING SHEET ICE

[76] Inventor: Paul Keller, 1004 94th Ave. NW., Coon Rapids, Minn. 55433

[21] Appl. No.: 509,322

[22] Filed: Jun. 30, 1983

[51] Int. Cl.[3] ..... F25C 5/12

[52] U.S. Cl. ..... 62/320; 62/354; 241/286; 241/DIG. 17; 403/4; 403/356

[58] Field of Search ..... 62/320, 354; 241/DIG. 17, 286; 403/4, 356, 359

[56] References Cited

U.S. PATENT DOCUMENTS

| | | | |
|---|---|---|---|
| 3,228,202 | 1/1966 | Cornelius | 62/320 X |
| 3,342,040 | 9/1967 | Dedricks et al. | 62/354 X |
| 3,593,539 | 7/1971 | Fiedler | 62/354 |
| 3,662,564 | 5/1972 | Clearman et al. | 62/320 |
| 4,198,831 | 4/1980 | Barnard | 62/320 |

*Primary Examiner*—William E. Tapolcai

*Attorney, Agent, or Firm*—F. D. Gilliam; David Pressman

[57] ABSTRACT

An ice breaking head for an ice producing machine is adjustable for producing harvested ice of selected sizes. The ice making machine has a cylinder, the inner surface of which produces commercial sheet ice. The ice is harvested by forcing the ice from out of the cylinder toward an ice breaking head. The position of ice breaking head is adjustable to vary the size of the ice harvested. The head has an ice breaking surface which contains fins for facilitating the breaking of the ice sheet. It is journalled on a mounting post which has keys or ribs of increasing heights which match corresponding keyway slots in the bore of the head so that the spacing of the head, and hence the size of the ice harvested, can be adjusted by changing the rotational position of the head on its mounting post.

13 Claims, 7 Drawing Figures

ADJUSTABLE ICE BREAKER FOR AN ICE MACHINE PRODUCING SHEET ICE

BACKGROUND OF THE INVENTION

The invention relates to an ice making machine of the hollow cylinder type, more particularly to the sizing of the ice harvested therefrom.

An example of this type of ice making machine is set forth in U.S. Pat. No. 3,228,202 issued Jan. 11, 1966 to R. J. Cornelius. The ice is formed within an ice making cavity in the form of cylinder and when harvesting is desired, the cylindrical ice sheet is forced through an opening in the top of the cylinder by internal force provided by a translating piston. As the ice leaves the cylinder it is forced against a plurality of fixed ice breaking fins, spaced around a circular ice breaking head thereby causing the ice to be broken in generally uniformly-sized flakes or pieces as it leaves the ice maker.

While this and other similar methods produce reasonably satisfactory ice, they have one general and important drawback: the size of the ice harvested is fixed in size; it cannot be altered.

Recent developments in cup vending machines provide for vending various size cups of liquid, as well as various types of liquid. These developments are creating requirements for ice making equipment to vend different sizes of harvested ice to provide a more enjoyable iced liquid. Currently the changing of harvested ice size requires the changing of the ice making device to a larger or smaller size unit.

For medical applications where ice size requirements are various, ice produced by standard ice making machines must be crushed prior to its use.

Thus, there is a continuing need for improved ice making machines and particular ice making machines which the size of the harvested ice can be selectively varied.

SUMMARY OF THE INVENTION

The above problem encountered in the state-of-the-art ice making machines and dispensing equipment is solved by the adjustable ice breaker head of the instant invention.

The ice making device to which the ice breaker head of the instant invention is applicable has a hollow cylinder lined with a plurality of narrow protrusions or ribs with the outer surface wrapped with a conventional refrigerant coil. The bottom surface of the cylinder is sealed by a base member which serves as a drain pan and a mounting surface for supporting an upper head assembly. Three stand-off rods extend from the base member to the upper head assembly. One of the three stand-off rods is hollow and also supplies ice making fluid to the upper head assembly. The upper head assembly contains a chamber and spray head for coating the inner cylinder walls with ice forming fluid and a vertically adjustable ice spreader or breaker. An ice harvesting piston translates within the cylinder by any conventional linear activating means conforming to the inner surface and protrusions or ribs of the cylinder.

In operation, ice forming liquid is supplied through the hollow stand-off rod to a hollow chamber in the upper head assembly where peripheral openings direct the flow of liquid down along the inside surface of the cylinder which has been pre-cooled by the refrigerant coil in a conventional manner. Ice is then formed by a layering effect on the inner surface of the cylinder, initially between the protrusions or ribs and then, depending on the desired ice thickness, over the protrusions or ribs. The harvesting piston is then translated, causing the ice to move out of the cylinder toward the upper head assembly. As the ice leaving the cylinder is forced against the ice spreader or breaker, the ice is fractured or cracked into semi-uniform, multi-faceted fragments which are then dispensed from the ice maker. The head portion carrying the ice spreader or breaker is vertically adjustable from an initial position, wherein the smallest of desired size fragments of ice are produced, to a maximum position away from the cylinder ice dispensing opening, where the largest desired size fragments of ice are produced. The head portion carrying the ice spreader or breaker can be selectively translated away from and toward the cylinder ice dispensing opening to any desired location between the smallest ice size position and the largest desired ice size position.

The adjustable positioning of the head is shown as having discrete incremented steps for ease of explanation and not by way of limitation.

The result is that the ice maker produces desirable selective sizes of ice which is hard and clear and has a desirable appearance in a glass or cup.

Details of the invention, and the preferred embodiment and process thereof, will be further understood upon reference to the drawings, wherein:

DETAILED DESCRIPTION OF THE PREFERRED EMBODIMENT

Figure 1:
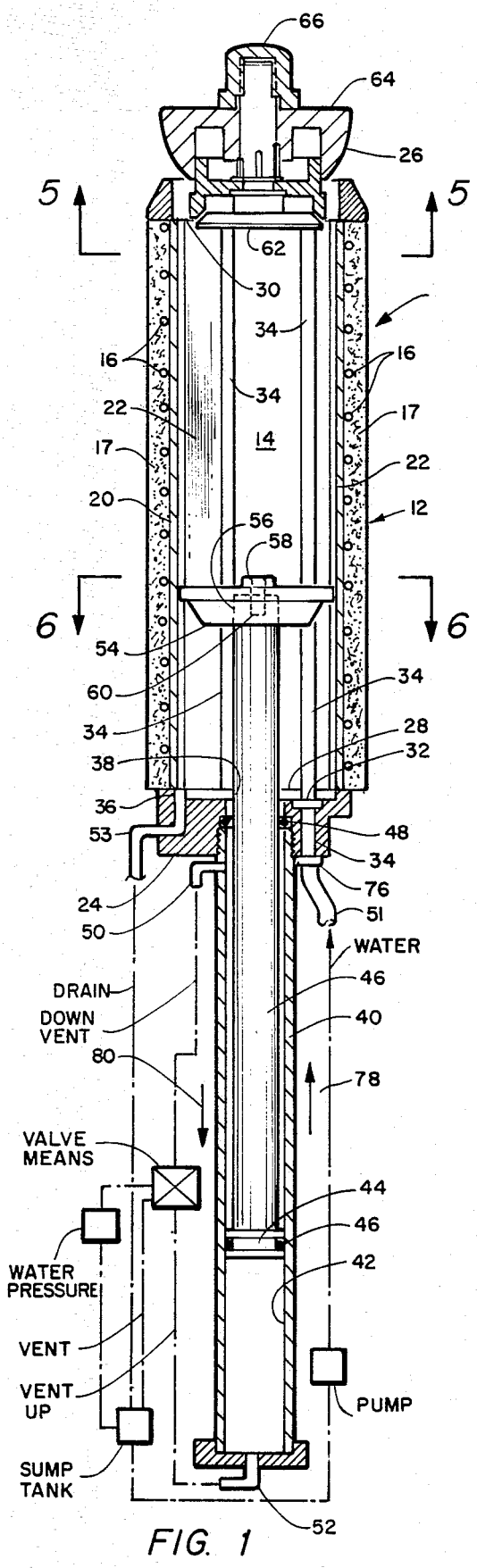
FIG. 1 is an exploded schematic representation, partially cutaway, of the ice maker and the adjustable head of the instant invention.

Referring now to FIG. 1, a body portion 12 of an ice maker generally takes the shape of a hollow cylinder. It should be understood, however, that body portion 12 may take other configurations and yet be suitable to practice the invention. The body portion 12 may be constructed of any suitable material, such as, but not limited to, stainless steel, brass, copper or similar heat conductive material. The outer surface of wall 20 of body portion 12 is wrapped with a plurality of spaced apart tubing 16. This tubing may be constructed from copper, aluminum, or the like material that can be easily and permanently around the body portion. The ends of tubing 16 are connected to a conventional refrigerant unit so that the tubing operates as the evaporator of the unit. The space between adjacent coils of tubing 16 is filled, and the outer surface of the tubing is covered with a suitable insulation material 17 to direct the temperature of the refrigerant passing through the coils to the body portion and to prevent energy loss externally therefrom.

The inner surface of wall 20 of body portion 12 has a plurality of longitudinally directed protrusions or ribs 22 extending substantially the entire length of interior chamber 14 of the body portion.

A base member 24 and a head assembly 26 are positioned at ends 28 and 30 respectively of body portion 12.

Figure 5:
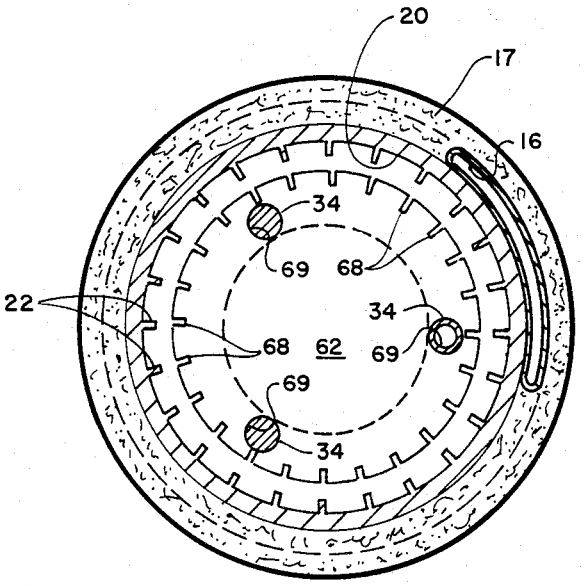
FIG. 5 is a showing of FIG. 1 taken along line 5—5.
Figure 7:
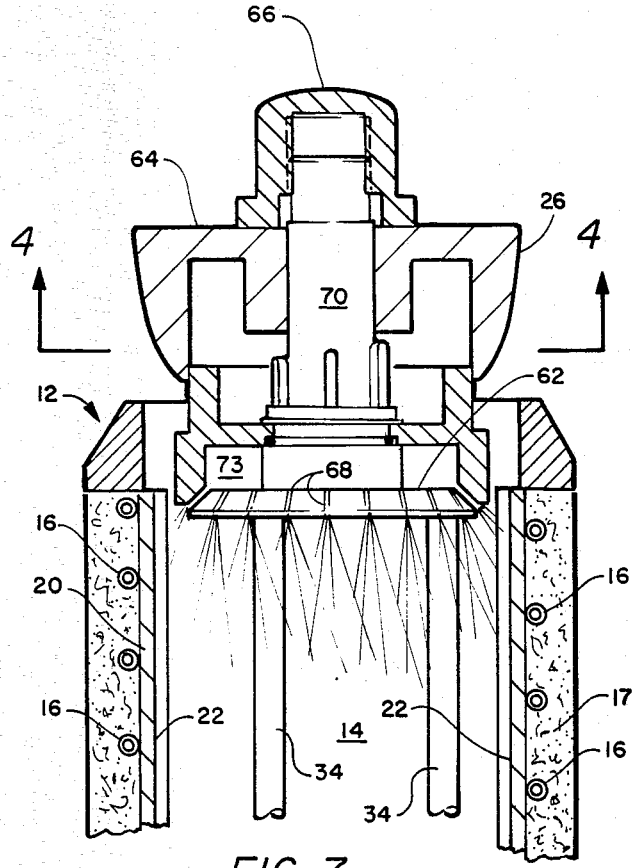
FIG. 7 is a showing of the upper portion of FIG. 1 with ice making liquid being sprayed on the inner surface of the ice making cylinder and the head in a maximum ice size position.
Figure 6:
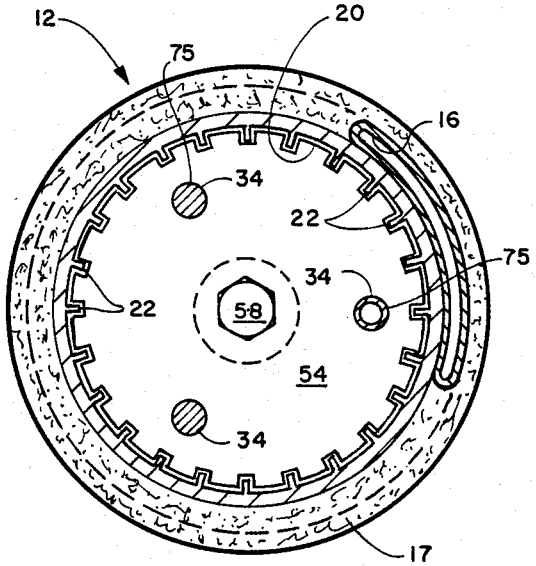
FIG. 6 is a showing of FIG. 1 taken along line 6—6.

Base member 24 is configured to form an abutting seal with end 28 of body portion 12 when secured thereto, as hereinafter described. Base member 24 has three apertures 32 (only one is shown in FIG. 1) for receiving three respective assembly rods 34 (best shown in FIGS. 5 to 7), a drain aperture 36, and a central aperture 38 for receiving in a sealed relationship a linear translating assembly 40.

Linear translating assembly 40 is a hydraulic linear activator which is operated by the same water source which supplies the ice making liquid. Translating assembly 40 comprises a cylinder 42, a piston 44, and a piston rod 46. The piston 44 includes a conventional "O" ring type seal 48. Hydraulic lines 50 and 52 connect to a valving system and a source of water under suitable pressure, generally in the range of from 15 to 70 psi.

An ice harvesting piston 54 conforms to the walls and protrusions or ribs and is fixedly attached to a top end 56 of piston rod 46. The attachment shown is by way of a bolt 58 which passes partially through an ice harvesting piston 54 and threadedly engaging a threaded aperture 60 in end 56 of rod 46. The piston rod has sufficient length to translate the ice harvesting piston from end 28 to end 30 of body portion 12.

Figure 3:
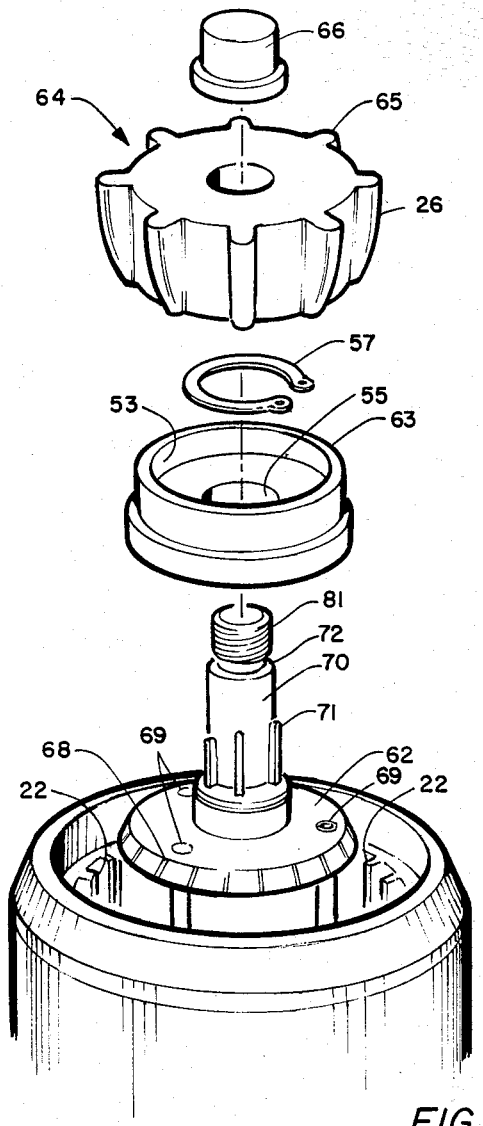
FIG. 3 is a perspective exploded view of the upper portion of the ice making cylinder and the translatable head assembly.
Figure 2:
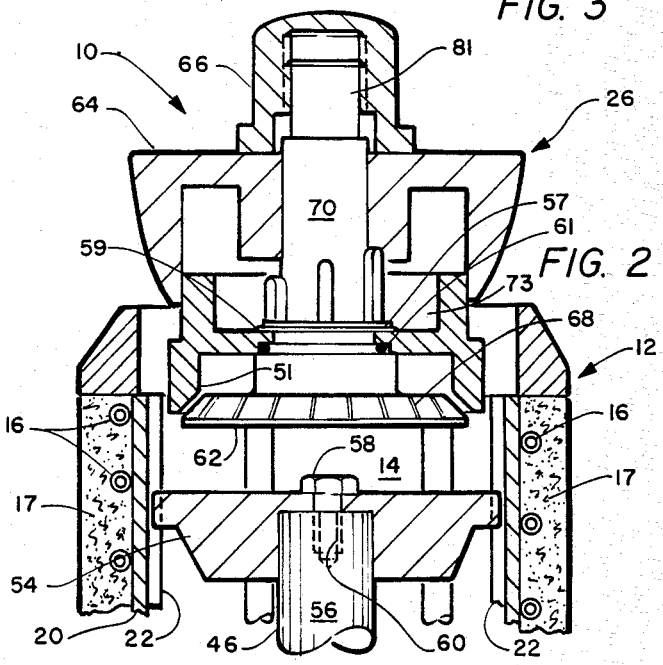
FIG. 2 is a showing of the upper portion of FIG. 1 with the ice harvesting piston translated and the head assembly in an intermediate position.
Figure 4:
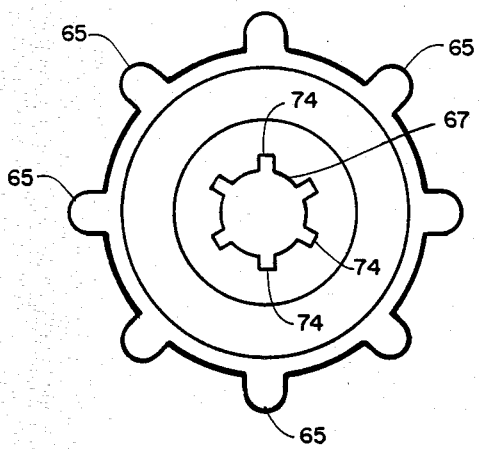
FIG. 4 is a showing of FIG. 3 taken along line 4—4.

Referring now specifically to FIGS. 2 to 4, it is seen that head assembly 26 includes a base 62, a collar 63, an ice spreader 64, and an end cap 66.

The base includes a plurality of notches 68 around its lower periphery, three spread apart apertures 69 for receiving rods 34, and a center post 70 which forms an extension of the base's upper surface. The center post is threaded at its upper end, has a plurality of vertical ribs or keys 71 either formed as an integral portion thereof or added thereto, and a locking groove 72 located intermediate the upper base surface and the lower terminus of the posts. The vertical ribs or keys are of different lengths and increase in height sequentially by substantially the same amount of increase. Six keys 71 are shown. The heights are shown to increase and equal in a counterclockwise direction. The increase in height could alternatively be in a clockwise direction if desired. A typical example of the amount of height increase would be in $\frac{1}{8}$ inch increments. In this increase example the shortest post would be $\frac{1}{8}$ inch, the next $\frac{1}{4}$, the next $\frac{3}{8}$, etc.

Collar 63 is formed with an open lower portion 51 (FIG. 2) and an open upper portion 53. The central portion between the lower and upper portions includes an aperture 55. The lower portion below aperture 55 has an enlarged countersunk surface 59 for receiving an "O" ring seal 61. When collar 63 is in position, aperture 55 slides over center post 70, whereby the "O" ring seal is positioned partially in the countersunk surface and the transition member is then forced against the upper surface of base 62 to form a liquid seal therebetween. Collar 63 is held in this position by a lock ring 57 captured within groove 72. When in place, the lower portion 51 of the collar forms a water tight reservoir 73 which interconnects with assembly rod 34.

Ice spreader 64 comprises a plurality of ice breaker fins 65 equally spaced around the outer periphery thereof. While eight fins are shown, it should be understood that more or less may be used in practice, depending upon the general widths of ice chips desired. Inner surface 67 (FIG. 4) of ice spreader 64 has a plurality of slots or keyways 74 that mate with keys 71 when the spreader is positioned on center post 70. Keys 74 are equal in number and height of each of the posts 71. That is, when the ice spreader is in a initial position each one of the keys nests against the upper surface of a respective slot 74. This is the smallest ice chip position.

According to the preferred embodiment shown, the ice spreader can be positioned in five different elevations from its initial position by rotating the ice spreader counter-clockwise relative to the posts, one slot at a time, until it again returns to its initial position. The length variations of the posts and slots can be any convenient equal incremental length, for example, and not by way of limitation as hereinbefore mentioned, one-eighth inch increments. This would provide a five-eighths variation in height of the ice breaker relative to base 62. As the separation of the breaker from the base increases, sequentially larger ice chips are harvested.

When the ice spreader is positioned on the base (all posts and slots engaged) a threaded end cap 66 (FIG. 3) is tightened on threads 81 and the ice spreader and base are held in their selected relative position.

Assembly rods 34 are secured to base 62 with the end of rod 34, which is hollow, extending into and having a sealed relationship with watertight reservoir 73 between the base member and transition member for the purpose of delivering ice making liquid to this reservoir. Rods 34 pass through apertures 75 in ice harvester piston 54, pass through apertures 32 (FIG. 1) in base member 24, and are secured at their threaded lower ends to base member 24 by nuts 76 (one shown) which allow easy disassembly. One of hollow rods 34, in addition to being secured by nut 76, is connected to a source of ice making liquid via supply line 51.

When the various components making up the ice maker are assembled, base end 28 is sealed to base member 24 and head assembly 26 is supported in a spaced relationship from interior 14 and head end 30 so that ice formed on the inner wall of the body portion can be forced out of end 30, as hereinafter described in detail.

OPERATION OF THE PREFERRED EMBODIMENT

For operation, the ice maker is assembled as shown in FIG. 1 and placed in an upright position, that is, the head end of the body is upright and the assembly is substantially plumb. Piston 44 is in a stowed position against the lower end of cylinder 42 as indicated by arrow 80, placing the ice harvester piston 54 substantially against the upper surface of base member 24. The refrigeration unit is activated and the refrigerant passing through coils 16 reduces the interior temperature of the chamber below the freezing temperature of the ice making liquid. Liquid is then supplied from a sump tank, in response to pressure from a pump, through line 51 and a hollow assembly rod 34, into reservoir 73 where liquid is sprayed through notches 68 in the periphery of base 62 to the wall surface of interior chamber 22 wherein ice is formed by a layering effect, first between and then over the protrusions or ribs 22 to a desired thickness. The liquid flow into the reservoir is then terminated. Hot gas is then circulated through coils 16 momentarily in a well known manner from the refrigerant source so as to release the ice from the cylinder wall. The formation of frozen liquid by a layering effect with the use of a circulating liquid, well known in the art, ensures clear, hard ice with a heat of fusion equal to substantially 144 BTU per pound.

When the freezing cycle is completed, by conventional control of time and/or temperature, a solid tube or cylinder of ice exists with deep grooves on its outer surface, corresponding to ribs 22.

Water under normal line pressure is now applied through hydraulic line 52 and hydraulic line 50 is vented to the sump tank, both functions being accomplished with known valve means. Ice harvesting piston 54 now translates upward in the direction of arrow 78 and is guided by assembly rods 34, aperture 38, and ribs 22. The translation of piston 54 causes the ice, which has mechanical stress lines along the protrusion or rib grooves, to be forced upward against ice breaker fins 65 carried by the ice spreader 64, where the ice fractures or cracks into multifaceted fragments. The ice leaves the interior of the body for deposit in a collection hopper (not shown). The general size of the random multifaceted cracked ice is determined in part by elevation of ice spreader 64 relative to base 62. The greater the relative displacement of the ice spreader and base, the greater the overall size of the cracked ice fragments. As hereinbefore mentioned, the displacement range between the ice spreader and base of the preferred embodiment is from approximately one-eighth of an inch to three-quarters of an inch.

This random, multifaceted shape of the cracked ice, together with its high heat of fusion, allows it to maintain its configuration, without remelting and fusing together, much longer than conventional cubed or flaked ice. This feature is primarily due to the small and random surface contact areas available for adjacent fragment joining.

After the ice is removed from the inner body portion, hydraulic line 50 admits ice making liquid (water) under line pressure to the opposite side of piston 44 and hydraulic line 52 is vented to the sump tank, both operations being performed by conventional valve means. Ice harvesting piston 54 now returns in the direction of arrow 80 to its original position against the lower inner surface of body portion 12. The cycle is then repeated as required. It should be noted that any excess liquid in the interior of the body portion is drained through aperture 36 and drain line 33 and returned to the sump tank for reuse.

Other variations, ramifications and applications of this invention will occur to those skilled in the art upon reading this disclosure. These are intended to be included within the scope of this invention, as defined by the appended claims and their legal equivalents.

What is claimed is:

1. In a sheet ice making machine of the type having a dispensing end for dispensing sheet ice, an improvement for enabling sheet ice pieces of any size within a range of sizes to be selectably produced, comprising:

ice breaker means spaced from said dispensing end, and adjustment means for selectively adjusting the spatial distance of said ice breaker means to any of a plurality of different fixed postions from said dispensing end so as to be able to break said ice sheet dispensed by said dispensing end into chips of selectively variable size.

2. The invention of claim 1 wherein said ice breaker means comprises a head having a surface against which said ice sheet is projected, said surface having a plurality of projecting fins thereon for facilitation of the breaking of said ice sheet into chips.

3. The invention of claim 1 wherein said adjustment means comprises a post projecting from said dispensing end, said ice breaker means comprises a head having a surface against which said ice sheet is projected, said head having a central opening through which said post extends.

4. The invention of claim 3 wherein said post has a plurality of keys projecting therefrom which are spaced around said post and oriented parallel to the axis of said post, said keys having sequentially-increasing heights, and wherein said central opening of said head has a corresponding plurality of keyway slots of sequentially increasing lengths, such that the position of said head on said post can be adjusted by changing the rotational orientation of said head on said post.

5. The invention of claim 4 wherein said keys and said slots each number six.

6. The invention of claim 4 wherein said keys progressively increase in length by about one-eighth of an inch.

7. The invention of claim 4 wherein said keys progressively increase in length in a counterclockwise direction when the projecting end of said post is viewed in an axial direction looking toward the base of said post.

8. The invention of claim 1 wherein said ice maker comprises a cylindrical chamber for dispensing a cylindrical sheet of ice therefrom, said ice breaker means comprises an ice breaker head having a cylindrical, flaring ice breaker surface whose diameter ranges from a value less than that of said cylindrical ice sheet to larger than said cylindrical ice sheet, said head being positioned so that said cylindrical ice sheet is projected against said ice breaker surface when it is dispensed from said cylinder, the position of said head being adjustable so that the length of said ice sheet projected against said head can be controlled.

9. The invention of claim 8 wherein said ice breaker surface has a plurality of ice breaker fins thereon, said fins being oriented generally parallel to the axis of said projected ice cylinder.

10. The invention of claim 9 wherein said adjustment means comprises a central opening in said ice breaker head with a plurality of axial keyway slots therein, said post projecting from said cylindrical chamber and extending through said central opening of said head, said post having a plurality of axial keys spaced therearound and positioned to mate with said respective keyway slots of said central opening, said keys having progressively increasing heights so that the spacing of said head from said cylindrical chamber can be adjusted by changing the rotational orientation of said head on said post.

11. The invention of claim 10 further including means for locking said head onto said post regardless of its rotational orientation thereon.

12. A machine for producing ice chips of selectable sizes comprising an ice maker for dispensing an ice sheet from a dispensing end thereof, ice breaker means for intercepting the dispensed ice sheet and breaking same, and means for adjusting the spatial distance of said ice breaker means from said dispensing end to any of a plurality of different fixed positions from said dispensing end so as to be able to control the size of the resultant ice pieces.

13. The invention of claim 12 wherein said ice maker comprises a cylindrical chamber for dispensing a cylindrical sheet of ice therefrom, said ice breaker means comprises an ice breaker head having a ice breaker surface positioned to intercept and break said cylindrical ice sheet as dispensed, said head having a central opening therethrough and said ice maker having a post projecting from the center of said cylindrical chamber, said post having a plurality of axial keys thereon and said central opening having a plurality of mating axial keyway slots therein, and means for holding said head onto said post so as to prevent said head from being translated away from cylindrical chamber and so that said keyway slots engage said keys and hold said head so that keys extend as far as possible into said keyways, said means permitting said head to be axially withdrawn up said post away from said cylindrical chamber to disengage said keys from said keyways, rotated, and repositoned down on said post so that keys reengage said keyways in a different manner so as to change the height of said head on said post, and hence the size of the resultant ice pieces.

* * * * *